United States Patent [19]

Anderson

[11] Patent Number: 4,626,033

[45] Date of Patent: Dec. 2, 1986

[54] CARPET AND TILE STRIPPER WITH CONTROLLABLE VECTOR

[76] Inventor: Martin L. Anderson, 4417 Third St., NE., Minneapolis, Minn. 55421

[21] Appl. No.: 672,602

[22] Filed: Nov. 19, 1984

[51] Int. Cl.[4] ..... A47L 11/12

[52] U.S. Cl. ..... 299/37

[58] Field of Search ..... 299/37, 80; 248/133, 248/371; 74/526

[56] References Cited

U.S. PATENT DOCUMENTS

| | | | |
|---|---|---|---|
| 2,512,987 | 6/1950 | Young | 74/526 |
| 4,009,908 | 3/1977 | Alinder et al. | 299/37 |
| 4,162,809 | 7/1979 | Anderson et al. | 299/37 |

*Primary Examiner*—Stephen J. Novosad

*Assistant Examiner*—Thomas J. Odar

*Attorney, Agent, or Firm*—Vidas & Arrett

[57] ABSTRACT

Improvements in oscillating carpet and tile strippers having a cutting blade mounted on a mounting and drive assembly which is connected to an eccentric driven by an electric motor to impart an orbital motion to the cutting blade. An adjustable motion retaining assembly operates to restrict the motion of the blade to decrease transverse movement and minimize centrifugal forces. A link of the motion retaining assembly is pivotally mounted between the drive bar and the frame. The drive bar mounting includes an elongated slot which allows a wide range of blade angles to be selected by positioning the link pivot in varying positions therewithin.

2 Claims, 4 Drawing Figures

CARPET AND TILE STRIPPER WITH CONTROLLABLE VECTOR

DESCRIPTION

1. Field of the Invention

This invention is directed to a carpet and tile stripping machine and more particularly to an improved machine of this type having an oscillatory cutting and stripping action which enables a single operator to remove carpet or tile that is bonded to a floor.

2. Background of the Invention

Machines for stripping carpet and tile bonded to a floor having accomplished their stripping or cutting action through the use of the reciprocating motion of blade members perpendicular to a cutting edge. Examples of such machines are shown in the Cawley U.S. Pat. No. 3,251,629 and Becker U.S. Pat. No. 2,905,614. Such machines have been ineffective to positively clean a floor or carpet or tile material bonded thereto because the cutting motion is reciprocating rather than a shearing type.

In U.S. Pat. No. 4,009,908 to Lloyd Anderson et al, the cutting blade of the carpet and tile stripper is driven through an oscillating member so that the blade pivots about a shaft in axial alignment with the travel of the carpet stripper. While this structure provides a relatively wide range of pivoting of the blade about a center point, this shearing action is not uniform because of the lack of movement at the center of the blade.

Floor covering strippers have been made utilizing a pure eccentric action to drive a cutting blade in an oscillating manner. U.S. Pat. No. 2,874,946 to Singleterry et al is an example. However, with such an arrangement, the journalling of the oscillating cutting blade and the degree of eccentricity of the drive to create the oscillation presents certain disadvantages. If the eccentricity is increased to increase the path of the blade movement, the vibration is increased. Also, a turning movement results due to the action of centrifugal force on the machine which results in difficulty in operating the machine and the possibility of damage to the machine. Further, if the oscillating part is not journaled, the machine is subject to extreme wear.

In U.S. Pat. No. 4,162,809 to Lloyd E. Anderson et al, an oscillating carpet and tile stripper is shown in which the cutting blade is mounted on a mounting and the drive assembly which is connected to an eccentric is driven by an electric motor to impart an orbital motion to the cutting blade. The end of the drive bar assembly adjacent the cutting blade is guided in translatory movement such that the movement of the cutting blade is at an angle to the frame and is slightly restricted in a transverse direction. A link pivoted on the frame attached to the elongated drive bar sets the angle of the blade mounting assembly with respect to the support frame to reduce the turning movement of the machine caused by centrifugal force and to reduce the vibration.

Although the link may be adjusted in length to alter the blade position, the distance between the drive shaft and the link pivot points always remains the same which limits its adjustability to a narrow range.

BRIEF SUMMARY

The present invention constitutes an improvement over the oscillating carpet and tile stripper shown and described in U.S. Pat. No. 4,162,809 to Lloyd E. Anderson et al. The motion retainer bar assembly of this invention provides an adjustable linkage between the support frame and the drive bar.

The drive bar includes an elongated slot extending between the front end of the drive bar toward a retaining plate. A short link is pivotally mounted to a journal on the frame and to the elongated slot. Blade travel may be easily adjusted over a very wide range relative to previous machines by sliding the link forward or backward along the elongated slot. The distance between the pivot point of the link to the axis of the motor shaft may, therefore, be varied. The evenness of the strokes made by the blade and the offset may be varied as desired.

The elongated drive bar is supported by a plate-shaped bearing which engages with a retaining plate of the drive bar in a sweeping action during operation to disttibute the wear over a large surface area. The drive bar is supported on its opposite side by the frictional engagement of a spherical bearing mounted to the drive bar with a retaining plate secured to the main frame.

DETAILED DESCRIPTION

Figure 4:
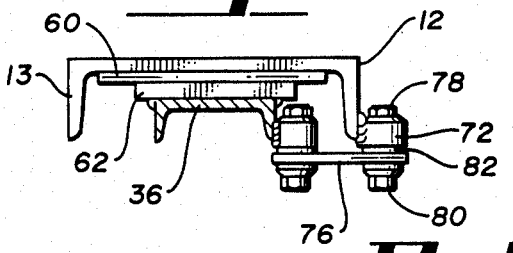
FIG. 4 is a sectional view of FIG. 3 taken along the line 4—4 therein to show the mounting of the cutting blade mounting assembly.
Figure 3:
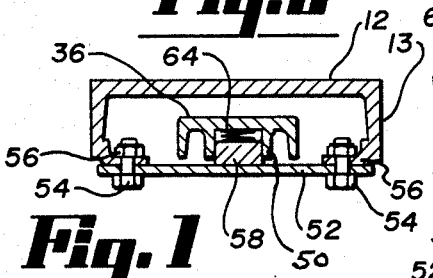
FIG. 3 is a side elevation view of the machine of FIG. 1 with portions cut away showing the relationship of internal moving parts.
Figure 2:
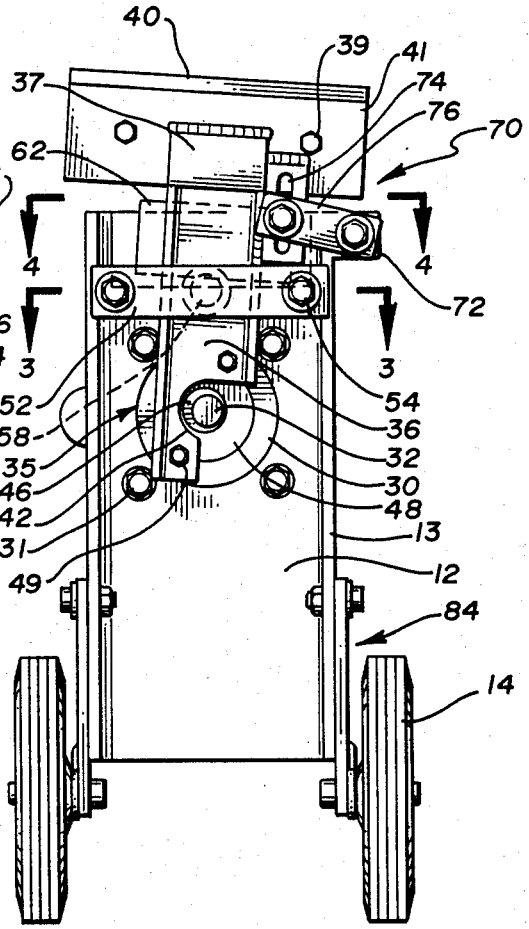
FIG. 2 is a bottom view of the drive mechanism of the machine of FIG. 1 with parts broken away.
Figure 1:
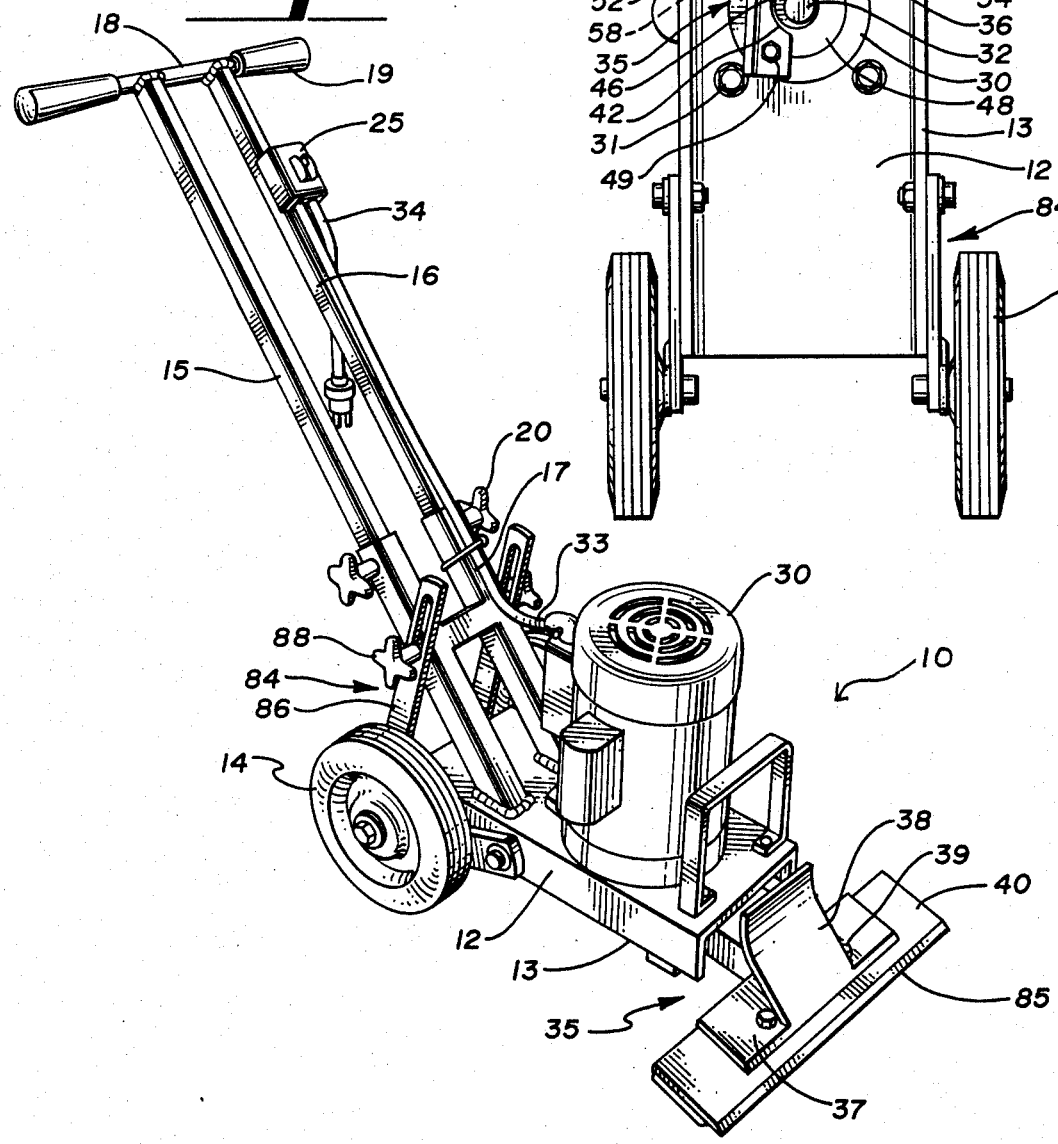
FIG. 1 is a perspective view of the machine embodying the invention.

The improved oscillating carpet and tile stripping machine is shown in perspective in FIG. 1 generally at 10. It includes a base or support frame 12 upon which a pair of wheels 14 are adjustably mounted on opposite sides of the base and adjacent the rear portion thereof. A handle member 15 is welded to the base 12 and extends rearwardly therefrom at an angle as shown terminating at the upper end thereof at a cross piece 18 which may be conveniently provided with suitable hand grip members 19. The handle 15 is a dual shaft unit formed in telescopic sections, as at 16, which slidably mount in fixed sections 17 welded to the frame 12. The sections 16 are held in position in the sections 17 by suitable pins or thumbscrews 20. The telescopic sections and pins permit the length of the handle to be adjusted to an individual's workman's discretion.

Positioned on the handle is a suitable switch 25 which controls the energization of a motor 30 which is mounted on the frame 12 and suitably bolted thereon through bolt members 31. A shaft 32 of the motor extends through an opening in the frame and to the underside thereof to provide a driving mechanism to be hereinafter described. The motor 30 is connected by a suitable electric cord 33 leading to the switch 25 with a cord 34 leading from the switch and having a suitable male plug at the end of the same for insertion into a normal wall outlet. This provides for the application of electric power to motor 30. Switch 25 is positioned on the handle 15 adjacent one of the grip members and it includes an operating lever to permit the switch to be turned on and off by the operator as he grips the handle.

The base or support frame 12 is a generally channel shaped steel member with downwardly extending sides 13 which form a housing beneath the frame in which a portion of a blade mounting assembly 35 is positioned and connected to the motor. The blade mounting assembly includes an elongated drive bar portion 36 with a transversely extending blade mounting portion 37 at the end of the same in a generally "T" shaped structure. The drive bar portion 36 is positioned beneath the support frame and the blade mounting portion 37 is positioned transversely to and spaced from the end of the support frame 12 at the front of the machine. The blade mounting portion is designed to mount a cutting blade, indicated generally at 40, and a suitable plate member 41 is positioned at the opposite side of the blade to be connected to the blade mounting portion 37 by nuts and bolts 39 which clamp the blade 40 therebetween.

The blade mounting portion has an inclined and bent tilt piece 38 suitably welded thereto which will aid in deflecting the floor covering material as it is removed from the floor. The blade 40 is moved in an orbital path. Motor 30 provides not only the driving force for the blade, but also provides the weight from the frame 12 to hold the blade 40 into positive engagement with the floor during operation of the machine and to provide an inertial mass by means of which the oscillating of the blade would be directed to the floor material.

The elongated drive bar portion 36 of the blade mounting assembly is a generally channel shaped structure made of steel having a length extending from the motor shaft to the blade mounting portion 37 which is welded thereto. The blade mounting portion is formed of a plate member extending normal to the channel structure of the drive portion 36 with a forward plate welded thereto and inclined to position the blade 40. The channel member or elongated drive bar portion 36 has an opening 42 near the end of the same through which shaft 32 of a motor 30 extends. The shaft is suitably secured by a key (not shown) to an eccentric member 46, the outer face of which is connected through a plate 48 to the elongated drive bar portion 36 by screws or nuts and bolts 49.

The forward end of the drive bar portion 36 has a cylinder member 50 welded thereon which projects downwardly from the same as shown. A retaining plate 52 is bolted to frame 12 with bolts 54 to flange members 56 welded thereon which project in from the edge of the channel shaped frame as shown. A spherical bearing 58 journals the elongated drive bar portion of the blade mounting assembly to the underside of support frame 12. The bearing is mounted within cylinder member 50 such that approximately one-half of the bearing extends beyond cylinder member 50. Bearing 58 is in frictional engagement with retaining plate 52 when the blade is lifted from the ground.

Main bearing 60 is plate shaped and is mounted to the underside of support frame 12 slightly forward of retaining plate 52 as shown. A plate 62 welded to the top of drive bar portion 36 is positioned immediately below main bearing plate 60 such that bearing plate 60 and plate 62 contact each other over a wide surface when the machine operates. As the machine oscillates, plate 60 sweeps back and forth over the surface of main bearing plate 60 distributing the wear over a large surface area. Preferably, the bearings described herewithin are self-lubricating bearings of the type sold under the trademark Oil-Rite ® by Oil-Rite Corp. of Manitowoc, Wis.

Bearings 58 and 60 provide support for the blade mounting assembly with the frame 12 to guide the blade mounting assembly for oscillating motion. It will be recognized that the blade mounting assembly is mechanically attached to the shaft of the motor and the bearings serve to space the drive bar portion of the blade mounting assembly from the support frame 12 and to jounal the same thereon.

Bearings 58 and 60 provide the support and wear surfaces for blade mounting assembly 35. During operation, the force of blade 40 against the floor and the weight of the motor on the frame will urge blade mounting assembly 35 to ride on bearing 60. Bearing 58 may include a spring 64 to urge the bearing downwardly so as to provide contact with retaining plate 52 during operation.

MOTION RETAINER BAR ASSEMBLY

As described above, machine 10 would provide an oscillating movement to cutting blade 40. However, the blade movement would be allowed to uncontrollably and unpredicably wander back and forth between the limits imposed by downwardly extending sides 13. In U.S. Pat. No. 4,162,809, a threaded link pivotably mounted between the drive bar and support frame limited the otherwise wild motion of the blade. A limited amount of offset could be achieved by disconnecting a pivot bolt and threading the link in or out. The pivot point on the drive bar always retains the same distance to the axis of the motor shaft. Only a quite limited range of adjustment is possible with such a link.

The motion retainer bar assembly 70 of this invention provides an adjustable linkage between the support frame 12 and the drive bar 36. Support frame 12 includes an outwardly extending ear 72 adjacent the front end and includes a journal therethrough. Drive bar 36 includes an elongated slot 74 extending between the front end of drive bar 36 adjacent blade mounting portion 37 toward retaining plate 52. A short link 76 is pivotally mounted to the journal on ear 72 and to elongated slot 74. Link 76 provides great strength and resistance to stress damage due to its short length of the travel when the device operates.

Link 76 is pivotally mounted to ear 72 and elongated slot 74 by means of bolts 78 and lock nuts 80 threaded therethrough. Preferably, a bearing inset 82 is provided in slot 72 and the ear journal so as to minimize the effects of friction. Preferably, insets 82 are selflubricating bearings of the type sold under the trademark Oil-Rite ® by Oil-Rite Corp. of Manitowoc, Wis. After the locknuts 80 are tightened, the link 76 retains the motion of the blade in a controlled, preset manner.

The offset provided by assembly 70 alters the normal eccentricity between the drive bar and the motor shaft. It also decreases the force required by the operator to hold the machine in a relatively straight line.

Assembly 70 restricts transverse movement of blade mounting portion 37 but allows reciprocal movement of the drive bar portion fore and aft of the frame through the action imparted by the eccentric.

However, merely restricting the transverse movement does not provide the advantages of the invention. It has been found that assembly 70 and its novel adjustability through elongated slot 74 allows an operator to easily adjust the blade travel over a very wide range relative to previous machines. When the link 76 is positioned closest to the retaining plate, the blade is offset in a direction opposite the direction of rotation and tends to counteract the effect of centrifugal force on machine 10 Also, due to the decreased distance between the motor and the link pivot point on the drive bar portion, the strokes made by the blade are more even. A more uniform shearing action is achieved in stripping actions. Blades wear more evenly and the entire edge of the blade operates as a stripper rather than merely one section of the blade edge.

When link 76 is positioned in slot 74 near blade mounting portion 37, the blade is canted in the opposite direction from that described above. Fore and aft motion of the blade is greater toward the edge in the direction of the centrigugal force applied by the machine.

An operator who desires to cut a straight path through tile or carpet merely loosens a single bolt, slides the link toward retaining plate 52 to suit his needs and retightens the bolt. An operator that intends to work along an edge of a room may use the centrifugal force of the machine to keep the blade working into the edge of the flooring rather than skipping away from the carpet or tile. In such a case, the operator adjusts the link by positioning it closer to the blade within the slot. Fore and aft movement of the blade will be greatest in the direction of the centrifugal force which further concentrates the stripping action of the blade to the edge of the material to be stripped.

Adjustment of the assembly is easily performed by an operator. No link needs to be removed and rotated as in earlier devices. A simple loosening of a nut, adjustment of the link within the slot and retightening is all that is needed to alter the motion of the blade.

The slot allows a much greater offset to be achieved than may be realized by a threaded link. Also, the simple link of the invention may deform slightly due to the forces applied by the motor without jamming as may be the case with threaded link controlled strippers.

The angle of the blade mounting portion 37 which holds the blade 40, is such as to provide a desired angle for the blade in its engagement with the floor surface beneath the carpeting or floor covering material at the floor level. The wheels 14 at the rear of the frame are made adjustable through a pivoted linkage system 84 which allows the wheels to pivot relative to the frame for rising or lowering the rear end of the frame and hence, changing the angle of the blade mounting portion. A suitable lever member 86 connects to the shaft 83 and the pivoted link system for raising or lowering the wheels relative to the frame. Thumb screws 88 allow the wheels to be adjusted quickly. When the frame is generally parallel with the floor lever, the angle of the blade mounting portion is about 30° to the floor in the cutting operation. The tip of the blade is beveled across the front surface and partially along the side surfaces as indicated at 85. The tip of the blade is self-sharpening in use and functions in an efficient manner to lift the carpeting or floor material from the floor. The metal back-up plate 41 extends across the width of the blade to stiffen the same and the curved plate 38 aids in starting the curve of the floor material as it is stripped or cut from the floor. The blade is suitably secured to the back-up plate 41 through the bolts 39 to the blade mounting portion so that it may be readily interchanged.

In considering this invention, it should be remembered that the disclosure, while preferred at present, is illustrative and the scope of the invention should be determined by the appended claims.

What is claimed is:

1. A carpet and tile stripping machine comprising a support frame;

motor means mounted on said frame;

said motor means including eccentric means driven by said motor means to produce orbital motion in a substantially horizontal plane; handle means connected to the rear portion of said frame for guiding and maneuvering said carpet stripping machine; a cutting blade mounting assembly positioned on said frame for orbital movement in a substantially horizontal plane; said assembly having an elongated drive bar portion and a transversely extending cutting blade mounting portion, said elongated drive bar portion being operatively connected to said eccentric means with said cutting blade mounting portions being positioned beyond the front of said frame whereby the cutting blade portion is driven in an orbital, substantially horizontal path by said eccentric means; the improvement comprising:

(a) motion retainer bar means connected at one end thereof to the drive bar portion and at the other end thereof to the front end of the frame, said ends being respectively connected to connection means wherein at least one of said means is adjustable to be capable of varying the distance between the connection means and the motor means; and (b) said motion retainer bar means including a link pivotally connected between the drive bar portion and the support frame, the pivot of said link attached to said drive bar portion being slidably adjustable along the length of said drive bar such that the angle between the drive bar portion and the support frame may be varied.

2. A carpet and tile stripping machine comprising a support frame;

motor means mounted on said frame;

said motor means including eccentric means driven by said motor means to produce orbital motion in a substantially horizontal plane; handle means connected to the rear portion of said frame for guiding and maneuvering said carpet stripping machine; a cutting blade mounting assembly positioned on said frame for orbital movement in a substantially horizontal plane; said assembly having an elongated drive bar portion and a transversely extending cutting blade mounting portion, said elongated drive bar portion being operatively connected to said eccentric means with said cutting blade mounting portions being positioned beyond the front of said frame whereby the cutting blade portion is driven in an orbital, substantially horizontal path by said eccentric means; the improvement comprising:

(a) motion retainer bar means connected at one end thereof to the drive bar portion and at the other end thereof to the front end of the frame, said ends being respectively connected to connection means wherein at least one of said means is adjustable to be capable of varying the distance between the connection means and the motor means; and (b) said drive bar includes an elongated slot extending along its length thereof, said motion retainer bar means including a link pivotally mounted between the support frame and said drive bar slots such that said link may be positioned more rearwardly or forwardly in said slot so as to alter the angle between said drive bar portion and the support frame.

* * * * *